United States Patent [19]

Hampel

[11] Patent Number: 5,054,041

[45] Date of Patent: Oct. 1, 1991

[54] HIGH PRECISION X-RAY COLLIMATOR

[75] Inventor: Willi W. Hampel, South Milwaukee, Wis.

[73] Assignee: General Electric Company, Milwaukee, Wis.

[21] Appl. No.: 495,687

[22] Filed: Mar. 19, 1990

[51] Int. Cl.[5] ..... G21K 1/04

[52] U.S. Cl. ..... 378/4; 378/150; 378/151

[58] Field of Search ..... 378/145, 147, 148, 149, 378/150, 151, 153, 15, 16, 160, 4; 192/1.1, 1.2, 1.52; 250/505.1, 363.10

[56] References Cited

U.S. PATENT DOCUMENTS

| | | | |
|---|---|---|---|
| 4,277,685 | 7/1981 | Covic et al. | 378/150 |
| 4,559,639 | 12/1985 | Glover et al. . | |
| 4,592,083 | 5/1986 | O'Brien | 378/160 |
| 4,991,189 | 2/1991 | Boomgaarden et al. | 378/4 |

*Primary Examiner*—Carolyn E. Fields
*Assistant Examiner*—David P. Porta
*Attorney, Agent, or Firm*—Quarles & Brady

[57] ABSTRACT

An x-ray collimator for collimating an x-ray beam is constructed of a rotatable mandrel with a series of longitudinal slots of varying widths. The width of the collimated beam may be controlled by rotating the mandrel so that the correct slot lines up with the uncollimated x-ray beam. The angle of the beam may also be corrected by smaller angular rotations of the mandrel to offset the exit aperture of the slot. The entrance aperture of each slot is larger than the exit aperture so that such centerline adjustments do not affect the x-ray fan beam width. A very low backlash brake holds the mandrel against perturbing torques when collimator is in position. The brake includes a friction element and a means of reducing the torque of the positioning motor to reduce the effect of such perturbing torques.

6 Claims, 5 Drawing Sheets

48
80
50
42
44
39
41
40
26
19
21
22
3a
38
46
X
Y
Z
45
43

FIG. 8
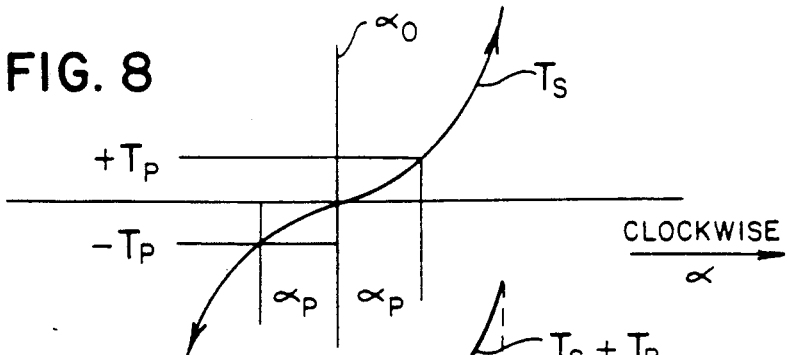
FIG. 9
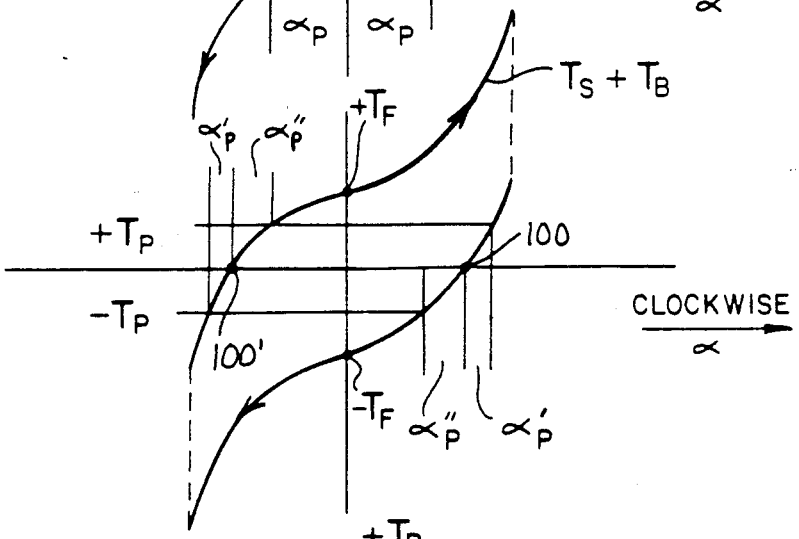
FIG. 10
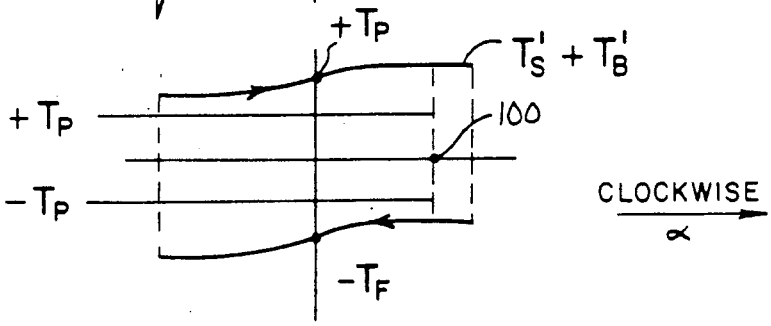
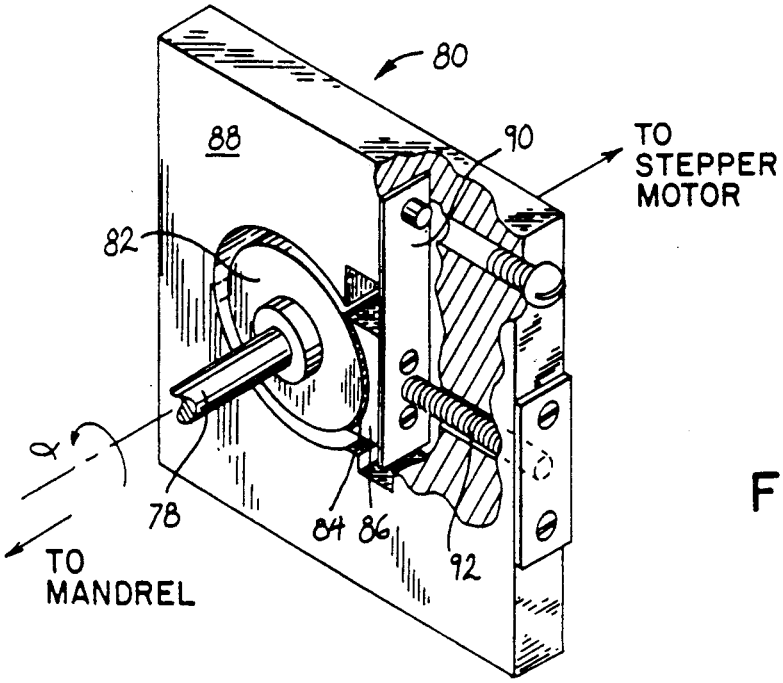
FIG. 11

HIGH PRECISION X-RAY COLLIMATOR

BACKGROUND OF THE INVENTION

This invention relates to x-ray collimators for use in computed tomography systems and the like and specifically to a collimator for precisely controlling an x-ray fan beam.

Computed tomography systems, as are known in the art, typically include an x-ray source collimated to form a fan beam directed through an object to be imaged and received by an x-ray detector array. The x-ray source, the fan beam and detector array are orientated to lie within the x-y plane of a Cartesian coordinate system, termed the "imaging plane". The x-ray source and detector array may be rotated together on a gantry within the imaging plane, around the imaged object, and hence around the z-axis of the Cartesian coordinate system. Rotation of the gantry changes the angel at which the fan beam intersects the imaged object, termed the "gantry" angle.

The detector array is comprised of detector elements each of which measures the intensity of transmitted radiation along a ray path projected from the x-ray source to that particular detector element. At each gantry angle a projection is acquired comprised of intensity signals from each of the detector elements. The gantry is then rotated to a new gantry angle and the process is repeated to collect an number of projections along a number of gantry angles to form a tomographic projection set. Each acquired tomographic projection set may be stored in numerical form for later computer processing to reconstruct a cross sectional image according to algorithms known in the art. The reconstructed image may be displayed on a conventional CRT tube or may be converted to a film record by means of a computer controlled camera.

The x-ray source is ordinarily an x-ray "tube" comprised of an evacuated glass x-ray envelope containing an anode and a cathode. X-rays are produced when electrons from the cathode are accelerated against a focal spot on the anode by means of a high voltage across the anode and cathode. The x-rays produced by the x-ray tube diverge from the focal spot in a generally conical pattern. A fan beam is formed by passing the x-rays through a slot flanked by x-ray opaque material. The process of restricting the x-ray beam to the desired fan beam is termed "collimation" and the slot assembly is termed a "collimator".

A collimator is typically comprised of two opposing metallic blades that may be opened and closed to change the width of the slot and hence to produce a fan beam with varying "thickness", as measured along the z-axis. Alternatively, the blades may be moved in the same direction to displace the centerline of the slot and hence change the fan beam angle with respect to the z-axis. Such a collimator will be termed an "adjustable blade collimator".

It is important that the fan beam have a uniform thickness. Variations in fan beam thickness will cause different detector elements in the detector array to receive different amounts of x-ray radiation despite possible constant attenuation of the imaged object. Generally, such variations in exposure of the detector elements, other than that those caused by the attenuation of the x-ray beam by the imaged object, will produce image artifacts and reduce the dynamic range of the reconstructed image.

When the fan beam is very narrow, uniform thickness of the fan beam is increasingly critical. Small absolute variations in fan beam width create large percentage changes in the exposure between detector elements. Such variations in fan beam width may result from collimator blades that are not parallel.

Motion of the focal spot of the x-ray, primarily the result of thermal expansion of the anode support structure as the x-ray source heats up, will affect the alignment of the fan beam with the imaging plane. The mathematics of image reconstruction assumes that each acquired projection is taken within a single plane. Lack of parallelism of the fan beam with the imaging plane will produces shading and streak image artifacts in the reconstructed image.

Both "ionization" type detectors and "solid state"detectors, as are known in the art, also exhibit changes in their sensitivity to x-rays as a function of the position of the fan beam along their surface. Accordingly, movement of the fan beam as a result of thermal drift of the focal spot may change the strength of the signal from the detector array. Such changes in signal strength during the acquisition of a tomographic projection set produce ring-like image artifacts in the resultant reconstructed image.

Copending application serial number U.S. Pat. No. 4,991,189 entitled: "Collimation Apparatus for X-ray Beam Correction"and assigned to the same assignee as the present invention, teaches the correction of the alignment of the fan beam with the detector array and the imaging plane by movement of the collimator slot along the z-axis direction. In such a system, it is desirable that the center of the collimator slot may be accurately translated along the z-axis to compensate for thermal drift of the focal spot. For the reasons described above, such z-axis translation should occur without changing the fan beam width or affecting the fan beam parallelism.

As previously mentioned, the gantry is rotated about the imaged object and the collimator is fixed relative to the gantry. Accordingly, the collimator experiences a constantly changing force of gravitational acceleration as well as other forces incident to such rotation. It is important, therefore, that a collimator also be able to resist such forces without adverse change in the fan beam's position or parallelism.

SUMMARY OF THE INVENTION

According to the present invention, a collimator is comprised of an x-ray absorbing mandrel having at least one diametrically directed passage extending along the length of the mandrel to create an aperture. A bearing supports the mandrel so that it may be rotated about its axis within an x-ray beam.

It is one object of the invention to provide an x-ray collimator to produce a fan beam of uniform thickness whose angle may be precisely controlled. The aperture in the mandrel is fixed in width and hence may be accurately machined to produce a highly uniform fan beam width. The rotating bearings and shape of the aperture allow limited translation of the center of the aperture along the z-axis, permitting accurate control of the fan beam angle without change in the fan beam width.

In one embodiment of the invention, additional diametrically directed passages are circumferentially spaced around the mandrel so that rotation of the mandrel will bring successive such passages into alignment with the x-ray beam. Each passage creates an aperture of different width.

It is thus another object of the invention to provide a collimation system that may produce fan beams of various widths, each such fan beam having a precisely repeatable width. Rotation of the mandrel about its axis by large amounts changes the aperture selected. Rotation of the mandrel by smaller amounts permits accurate control of the fan beam angle. It is another object of the invention to produce a collimator that may be rapidly adjusted without the need for complex mechanisms. The collimator width and the fan beam angle are both adjusted by rotation of the mandrel. This rotation may be accurately controlled by a position feedback loop. A simple bearing assembly accurately maintains the collimator alignment.

A low backlash brake holds the mandrel against rotation when it is not being repositioned. The brake is comprised of a friction element providing a threshold frictional torque resisting rotation of the mandrel and a motor controller which reduces the motor restoring torque during braking.

It is therefore a further object of the invention to produce a robust collimator mechanism resistant to the perturbing torques from accelerative forces acting on the collimator as the gantry rotates. The mandrel is compact, reducing it moment of inertia and hence the torquing actions of external forces. Motion other than rotation is prevented by the bearings which hold either end of the mandrel. The low backlash brake is activated when the mandrel is not being moved.

Other objects and advantages besides those discussed above shall be apparent, to those experienced in the art, from the description of a preferred embodiment of the invention which follows. In the description, reference is made to the accompanying drawings, which form a part hereof, and which illustrate one example of the invention. Such example, however, is not exhaustive of the various alternative forms of the invention, and therefore reference is made to the claims which follow the description for determining the scope of the invention.

BRIEF DESCRIPTION OF THE DRAWINGS

FIGS. 3(*a*) and (*b*) are cross-sectional views of the mandrel of the collimator of FIG. 2 showing orientation of the mandrel for thick and thin fan beams respectively;

FIG. 8 is a plot of the torque $T_s$ vs angle $\alpha$ for a typical stepper motor such as that shown in FIG. 2.

FIG. 9 is a plot of the sum of stepper motor torque $T_s$ and brake torque $T_s$ vs angle $\alpha$ for the collimator with the low backlash brake before reduction of the motor torque $T_s$;

FIG. 10 is a plot of the sum of stepper motor torque $T_s$ and brake torque $T_s$ vs angle $\alpha$ for the collimator with the low backlash brake after reduction of the motor torque to $T_s'$;

FIG. 11 perspective view of the low torque brake of FIG. 2 in isolation from the collimator and with a portion cutaway for clarity.

DETAILED DESCRIPTION OF THE PREFERRED EMBODIMENT

Figure 1:
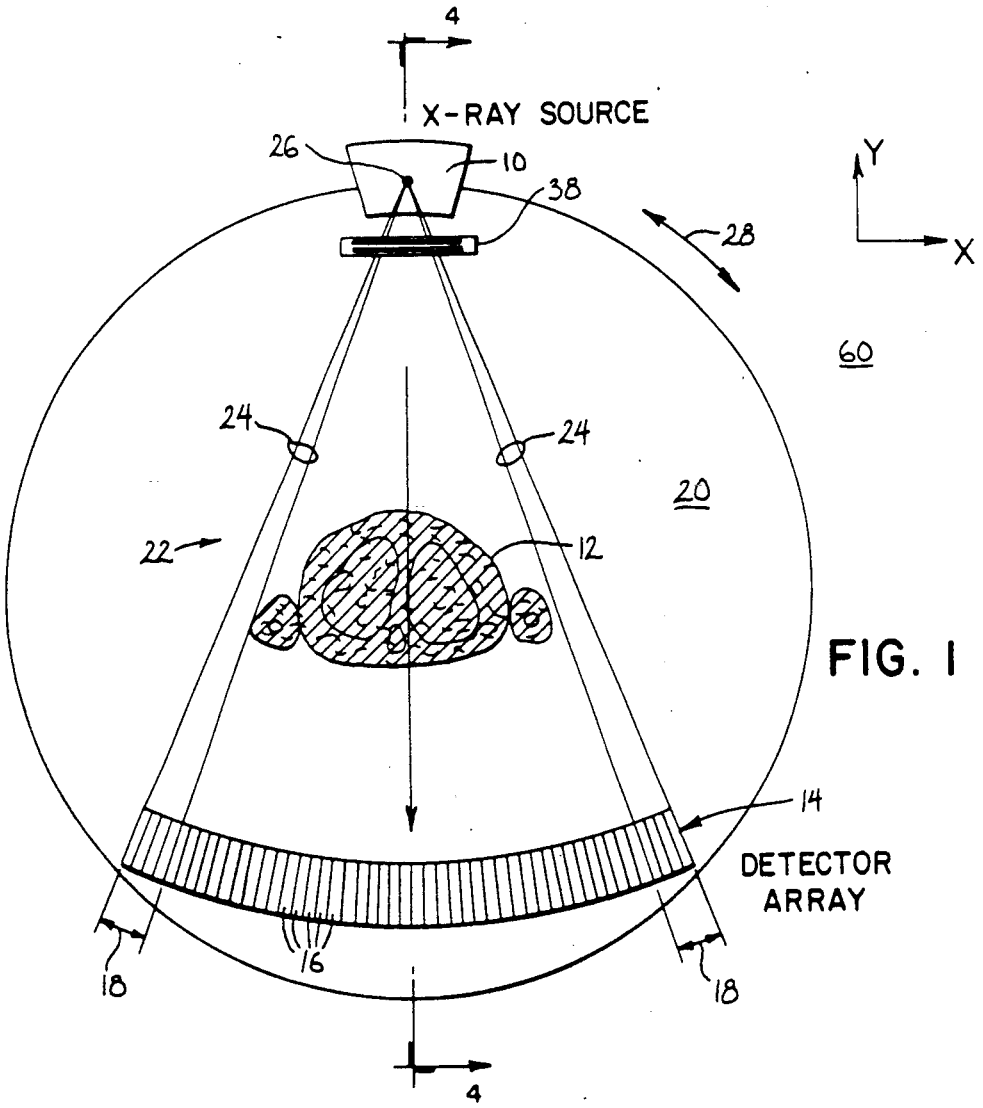
FIG. 1 is a schematic representation of an x-ray source and x-ray detector positioned on a CT gantry as may be used with the present invention, and showing the relative position of the collimator of the present invention.

Referring to FIG. 1, a gantry 20, representative of a "third generation" computed tomography scanner, includes an x-ray source 10 collimated by collimator 38 to project a fan beam of x-rays 22 through imaged object 12 to detector array 14. The x-ray source 10 and detector array 14 rotate on the gantry 20 as indicated by arrow 28, within an imaging plane 60, aligned with the x-y plane of a Cartesian coordinate system, and about the z-axis of that coordinate system.

The detector array 14 is comprised of a number of detector elements 16, organized within the imaging plane 60, which together detect the projected image produced by the attenuated transmission of x-rays through the imaged object 12.

The fan beam 22 emanates from a focal spot 26 in the x-ray source 10 and is directed along a fan beam axis 23 centered within the fan beam 22. The fan beam angle, measured along the broad face of the fan beam 22, is larger than the angle subtended by the imaged object 12 so that two peripheral beams 24 of the fan beam 22 are transmitted past the body without substantial attenuation. These peripheral beams 24 are received by peripheral detector elements 18 within the detector array 14.

Figures 2, 3A, 3B:
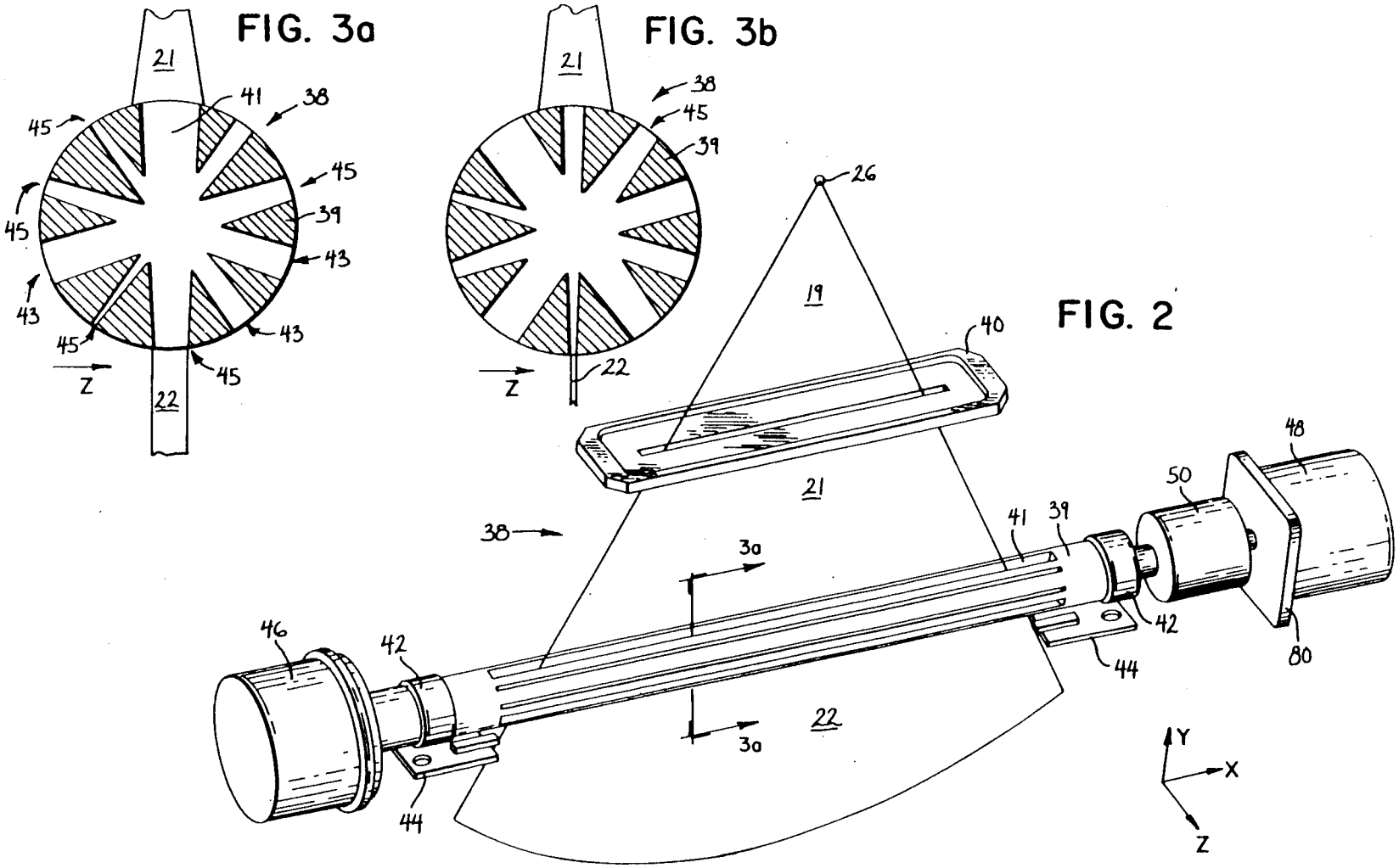
FIG. 2 is a perspective view of the collimator assembly of the present invention showing the mandrel, the stepper motor and the low backlash brake.

Referring to FIG. 2, uncollimated x-rays 19 radiating from the focal spot 26 in the x-ray source 10 (not shown in FIG. 2) are formed into a coarse fan beam 1 by primary aperture 40. The coarse fan beam 21 is collimated into fan beam 22 by means of collimator 38.

Referring generally to FIGS. 2, 3(*a*) and 3(*b*), collimator 38 is comprised of a cylindrical x-ray absorbing mandrel 39 held within the coarse fan beam 21 on high precision bearings 42 allowing the mandrel 39 to rotate along its axis. The mandrel material is a sintered molybdenum to provide both good x-ray absorbing characteristics and randomly oriented residual stress ensuring dimensional stability after the necessary machining.

A plurality of tapered slots 41 are cut through the mandrel's diameter by wire electro-discharge machining and extend along the length of the mandrel 39. The slots 41 are cut at varying angles about the mandrel's axis to permit rotation of the mandrel 39 by approximately 36° to bring each such slot 41 into alignment with the coarse fan beam 21 so as to permit the passage of some rays of the coarse fan beam 21 through the slot 41 to form fan beam 22.

Referring to FIG. 3(*a*) and 3(*b*), the tapered slots 41 are of varying width and hence the rotation of the mandrel 39 allows the width of the fan beam 22 to be varied between a narrow width (mm) as shown in FIG. 3(*b*)

and wide width (10mm) as shown in FIG. 3(*a*). The fixed slots 41 ensure dimensional accuracy and repeatability of the fan beam 22. The tolerances on the narrowest slot 41 are +0.001 inches −0.000 inches with proportional tolerances on the larger slots 41.

The slots 41 are tapered so that the entrance aperture 43 of each slot 41, when orientated with respect to the coarse fan beam 21, is wider than the exit aperture 5. The exit aperture 45 defines the width of the fan beam 2 and the extra width of the entrance aperture 43 prevents either edge of the entrance aperture 43 from blocking the coarse fan beam 21 during rotation of the mandrel 39 when such rotation is used to control the alignment of the fan beam axis 23 as will be discused in detail below.

Referring again to FIG. 2, a stepping motor 48 is connected to one end of the mandrel 39 by coupling 50 that is stiff torsionally but flexible in other directions, and a low backlash brake 80 to be described further below. The stepping motor 48 is operated in the microstep mode as is known in the art to provide a stepping increment of 50,800 steps per revolution. The stepper motor and controller are commercially available from Oriental Motor and compumotor, respectively.

The remaining end of the mandrel 39 is attached to a position encoder 46 which allows accurate positioning of the mandrel by motor 48. The position encoder is of the incremental type, providing 20,000 pulses per revolution and a home or zero pulse used to determine absolute position.

Fan beam angle shutters 44 at either ends of the mandrel 39 control the length of the fan beam 22.

Figure 4:
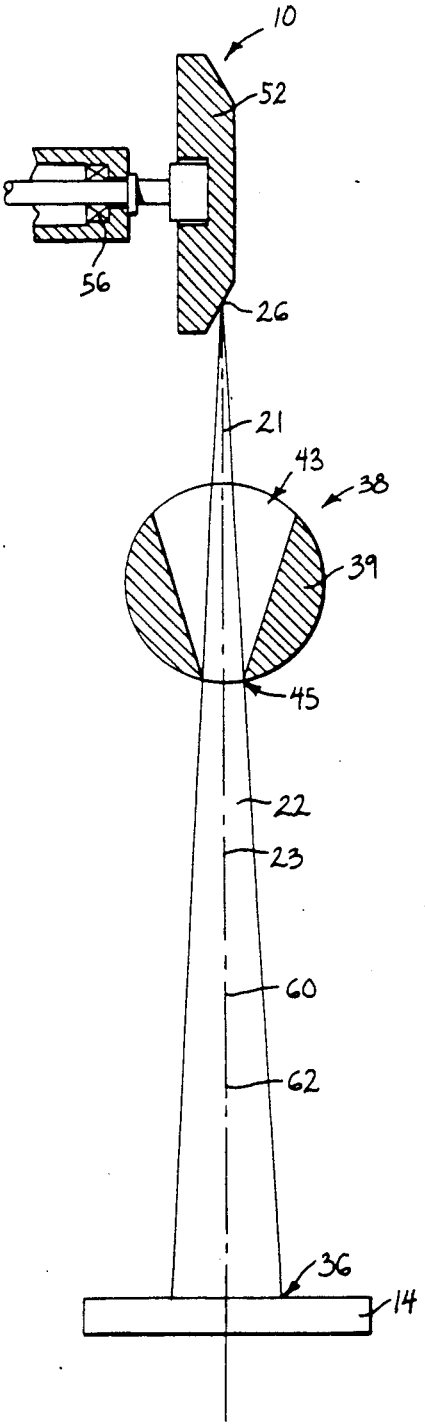
FIG. 4 is a simplified cross sectional view of the path of the x-ray fan beam, taken along line 4—4 in FIG. 1, with the x-ray tube anode, the collimator and the detector array exaggerated for clarity.

Referring to FIG. 4, the x-ray source 10 is comprised of a rotating anode 52 held within an evacuated glass tube (not shown) and supported by supporting structure including principally anode shaft 54 which is held on bearings 56 (one shown). The coarse fan beam 21 emanates from focal spot 26 at the surface of the anode 52. The coarse fan beam 21 is collimated by the collimator 38 to form a fan beam 22 as previously described.

The plane containing the focal spot 26, the center line of the exit aperture 45, and the centerline of the detector array 14 along the z axis, and thus bisecting the fan beam 22 in the z axis direction, will be termed the "fan beam plane" 62.

Figure 5:
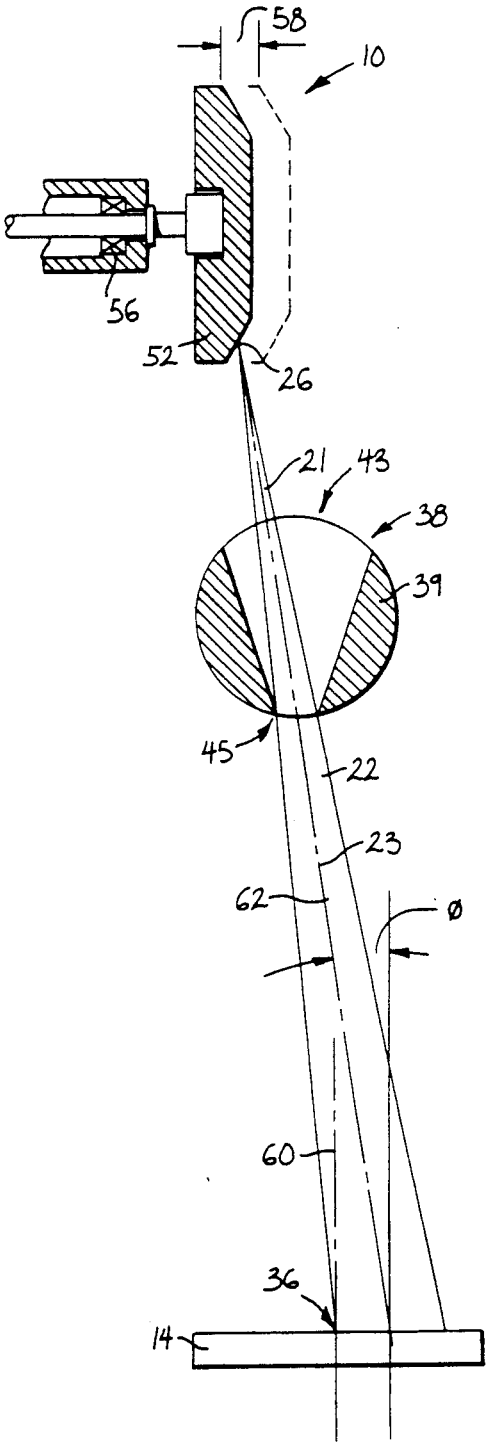
FIG. 5 is a cross sectional view, similar to that of FIG. 4, showing the effect of thermal drift of the x-ray anode on fan beam alignment.

As previously described, the focal spot 26 may not be aligned with the imaging plane 60 either because of thermal drift of the anode 52 and its supporting structure or because of minor misalignment of the x-ray source 10 during assembly. Referring to FIG. 5, the anode 52 is shown displaced from the imaging plane 60 by misalignment distance 58. The effect of this misalignment is to displace focal spot position away from the imaging plane 60 and to move the the center of the fan beam exposure area 36 in the opposite direction.

As a result of the movement of the focal spot 26, as shown in FIG. 5, the exposure area 36 is no longer centered within the imaging plane 60 and the fan beam plane 62 is no longer parallel with the imaging plane 60 but deviates by angle $\phi$.

Figure 6:
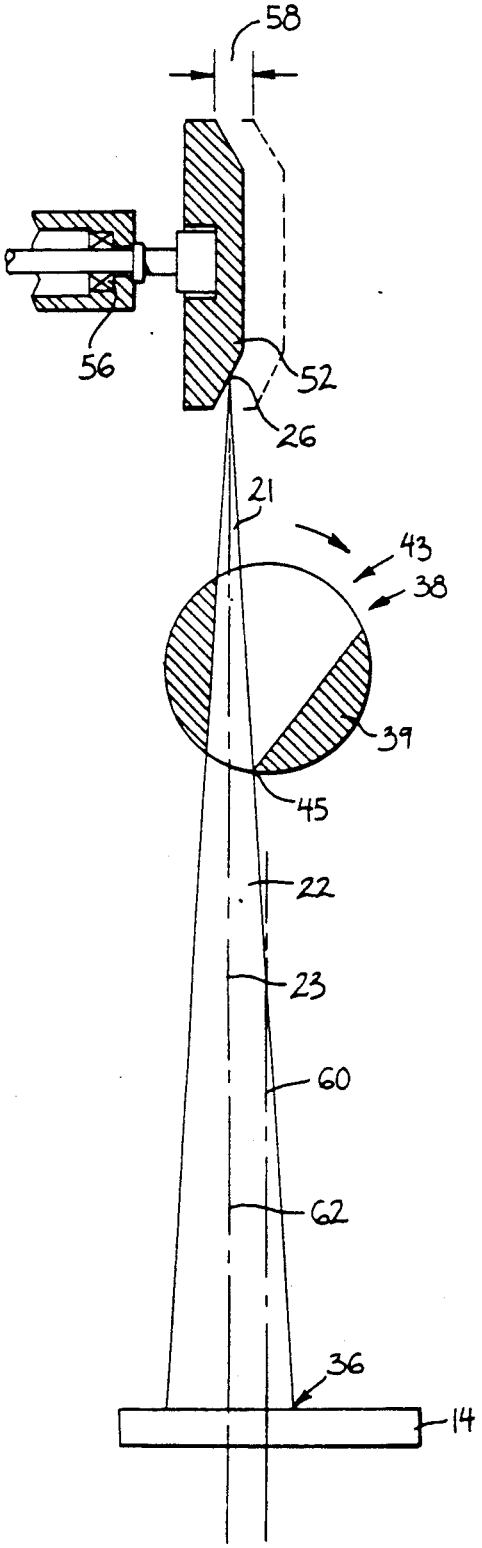
FIG. 6 is a cross-sectional view, similar to that of FIG. 5, showing rotation of the collimator to make the fan beam plane parallel with the imaging plane.

Referring to FIG. 6, the collimator 38 may be rotated to restore the fan beam plane 62 to parallel with the imaging plane 60. This correction of the angle of the fan beam plane 62 will be termed "parallelism correction".

Figure 7:
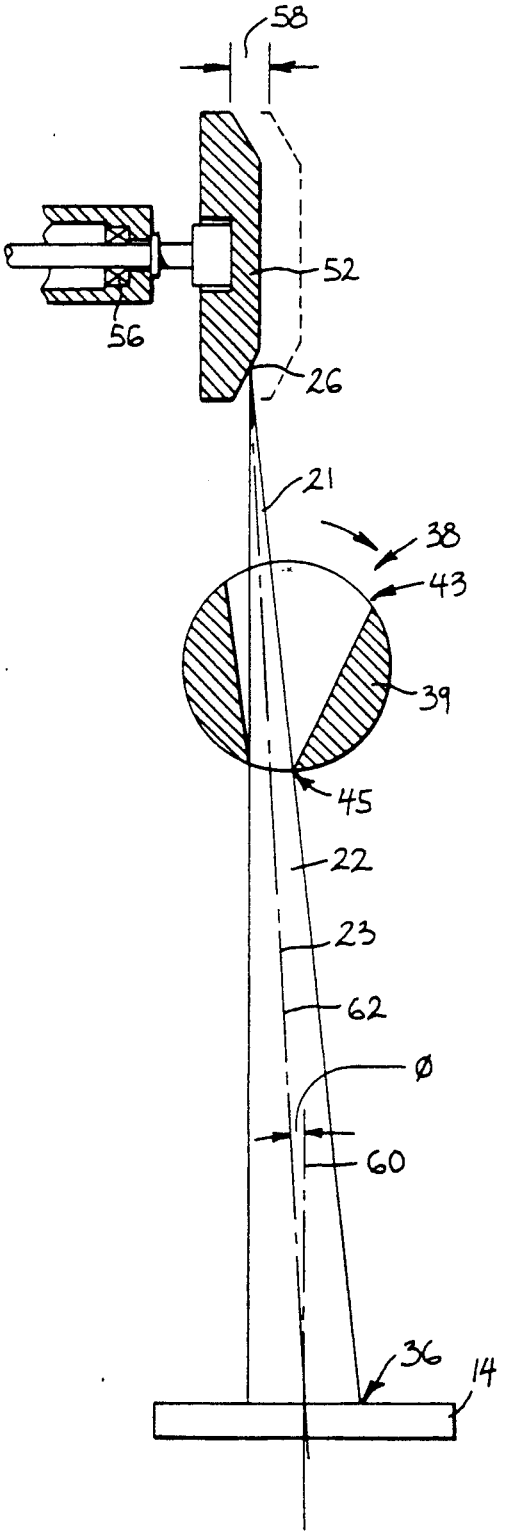
FIG. 7 is a cross-sectional view, similar to that of FIG. 5, showing rotation of the collimator to align the fan beam with the detector array.

Alternatively, referring to FIG. 7, the collimator 38 may be rotated so that the exposure area 36 will again be centered at within the imaging plane 60. Correction of the position of the of the fan beam exposure area 36 with respect to the detector 14 will be termed "z-axis offset correction".

In summary, rotation of the collimator 38 may correct for misalignment of the fan beam plane 62 either to make it parallel with the imaging plane 60 or to bring the exposure area 36 into alignment on the detector array 14. As previously discussed, both of these corrections will reduce image artifacts.

As discussed, various external forces act on the collimator 38 during the rotation of the gantry 20 shown in FIG. 1. The torque on the mandrel 39, exerted by these forces, is resisted by means of a low backlash brake 80 as shown in FIG. 2. Referring now to FIG. 8, the torque $T_s$ of the stepper motor 48 varies as a function of the angular displacement $\alpha$ of its shaft 78 around a step position $\alpha_o$. The torque $T_s$ rises from zero torque at $\alpha_0$ to positive values (representing counterclockwise torque) as one moves in a clockwise direction away from $\alpha_o$, and the torque $T_s$ drops from zero torque to negative values (representing clockwise torque) as one moves in a counterclockwise direction away from $\alpha_o$. This is typical of the torque characteristics of a positioning motor and reflects the positioning action of the motor around at $\alpha_o$.

Referring again to FIG. 1, the collimator mandrel 39 is disposed tangentially to the rotation 28 of the gantry 20 and hence experiences a steady centripetal acceleration and a rotating gravitational acceleration depending on the position and velocity of the gantry 20. The complex cross-section of mandrel 39 prevents it from being perfectly balanced under these varying accelerative forces and hence there exists a small but significant perturbation torque $\pm TP$ on the mandrel 39 during rotation of the gantry 20. Referring again to FIG. 8, when the stepping motor is energized this perturbation torque $\pm T_p$ may move the mandrel by as much as $\pm \alpha p$ before it is resisted by the restoring torque $T_s$ of the stepping motor 48.

Referring to FIG. 11, the effect of the perturbation torque $\alpha T_P$ may be counteracted by means of the low backlash brake 80 comprised of a brake drum 82 affixed to, and coaxial with, the shaft 78 of the stepper motor 48 connected with the mandrel 39. A brake pad 84 attached to an arcuate brake shoe 86 is positioned in sliding contact with the circumference of the brake drum 82 so as to create a frictional countervailing braking torque $T_B$. The brake shoe 86 is attached to a housing 88 by means of a flexible arm 90 of spring steel.

The flexible arm 90 is orientated tangentially to the brake drum 82 to flex only in a radial direction and hence to be unyielding with respect to tangential forces imparted by the friction between the brake drum 82 and the brake lining 84. A biasing spring 92 serves to impart an inward radial force to the brake shoe 86 and brake pad 84 against the circumference of the brake drum 82 and hence to establish the frictional braking torque $T_F$ which may be adjusted by controlling the compression of biasing spring 92 and hence the force imparted by the biasing spring 92 on the brake shoe 86.

Referring again to FIG. 9, the braking torque $T_B$ is essentially constant with angle $\alpha$ and equal to $T_F$ and always opposing the direction of rotation. The braking torque $T_B$ only counteracts the other torques and drops to zero when there is no motion. The braking torque $T_B$ creates the hysteresis curve of FIG. 9 where the torque curve $T_S$ is displaced by $\pm T_F$ depending on the direction of rotation of shaft 78.

With the braking torque $T_s$, the stepping motor 48 will position its shaft at equilibrium point 100 or 100' removed from $\alpha_o$ depending on the direction which the stepping motor 48 approaches $\alpha_o$. In the preferred embodiment, the stepper motor always turns in the counterclockwise direction (as viewed from the non-shaft side of the stepper motor) to ensure that its shaft 78 will always stop at equilibrium point 100.

When the shaft 78 of the stepper motor 48 has reached position 100, the braking torque $T_B$ and the stepper motor torque $T_S$ are just balanced and the shaft 78 of the stepper motor 48 stops. Nevertheless, the shaft 78 is not immune from perturbation torque $T_P$ which may unbalance this equilibrium in either direction, even if $T_P$ is less than $T_F$. This displacement is designated $\alpha_p'$ and $\alpha_p''$ depending on the direction of perturbation. In general, the displacement $\alpha_p'$ and $\alpha_P''$, with the brake 80, will be less than the displacement $\alpha_p$ without the brake 80 as shown in FIG. 8.

Referring to FIG. 9, once the stepper motor 48 has positioned its shaft 78 at point 100, the power to the stepper motor 48 is reduced to lessen the amount of the stepper motor restoring torque $T_s$, for small displacement angles $\alpha$ of shaft 78, to $T_s'$, where $T_s' << T_F$ for small angles $\alpha$. This reduction of torque $T_s$ may be obtained by reducing the current flowing through the windings of the stepper motor 48 as is understood in the art. Now the braking torque $T_s$ provides a nearly constant resisting force to motion in either direction and will prevent motion of the shaft 78 from perturbing torques $T_P$ so long as $-T_F > T_P > T_F$. Therefore, somewhat counterintuitively, the braking action is improved by reducing the stepper motor restoring torque $T_s$ to $T_s'$. The stepper motor 48 is not shut off completely, however, so as to provide resistance to higher perturbation torques than $T_P$ and to prevent shifting of the mandrel 39 by large angles $\alpha$.

The above description has been that of a preferred embodiment of the present invention. It will occur to those who practice the art that many modifications may be made without departing from the spirit and scope of the invention. In order to apprise the public of the various embodiments that may fall within the scope of the invention, the following claims are made.

I claim:

1. In a computed tomography system including an x-ray source producing an x-ray beam along a fan beam axis, an x-ray collimator for controlling the angle of the fan beam axis of a collimated fan beam comprising:

an elongate x-ray absorbing mandrel positioned within the x-ray beam and having a diametrically directed passage extending along the length of the mandrel within the x-ray beam to create one entrance and one exit aperture in the circumference of the mandrel; and a bearing means for holding the mandrel so that it may be rotated about its axis to adjust the angle of the fan beam axis.

2. In a computed tomography system including an x-ray source producing an x-ray beam along a fan beam axis, an x-ray collimator for controlling the angle of the fan beam axis of a collimated fan beam and the width of the collimated fan beam comprising:

an x-ray absorbing cylindrical mandrel positioned within the x-ray beam and having a plurality of intersecting diametrically directed slots extending along the mandrel within the x-ray beam, with the slots being of different width and disposed at varying angles along the axis of the mandrel to create one entrance and one exit aperture in the circumference of the mandrel for each slot; and a bearing means for holding the mandrel so that it may rotate about its axis to align a give slot with the ray beam to produce a collimated fan beam of a particular width and with a particular fan beam angle.

3. The collimator of claim 2 wherein each entrance aperture is larger than each corresponding exit aperture.

4. The collimator of claim 2 wherein the mandrel is composed of a solid bar of sintered metal having diametrically directed slots cut therein.

5. A brake assembly for holding a rotatable collimator at a position $\alpha_o$ against the action of perturbation torques, upon receipt of a braking signal, comprising:

a motor means for applying a restoring torque to the rotatable collimator, said torque dependant on the rotational position of the rotatable collimator with respect to $\alpha_o$;

a friction means for applying a frictional torque to the rotatable collimator such frictional torque being greater than the perturbation torque; and a motor torque control means for decreasing the motor restoring torque upon receipt of a braking signal.

6. The collimator of claim 2 including a brake assembly for holding the collimator at a position $\alpha_o$ against the action of perturbation torques, upon receipt of a braking signal, comprising:

a motor means for applying a restoring torque to the collimator, said torque dependant on the rotational position of the collimator with respect to $\alpha_o$;

a friction means for applying a frictional torque to the collimator such frictional torque being greater than the perturbation torque; and a motor torque control means for decreasing the motor restoring torque upon receipt of a braking signal.

* * * * *